United States Patent [19]

Komatsu et al.

[11] Patent Number: 4,510,767

[45] Date of Patent: Apr. 16, 1985

[54] COLD STORAGE AND REFRIGERATION SYSTEM

[75] Inventors: Fumiaki Komatsu; Kazuyuki Saegusa; Yu Seshimo; Norio Yamashita, all of Kanagawa, Japan

[73] Assignee: Mitsubishi Denki Kabushiki Kaisha, Tokyo, Japan

[21] Appl. No.: 401,046

[22] Filed: Jul. 22, 1982

[30] Foreign Application Priority Data

| | | | |
|---|---|---|---|
| Jul. 3, 1981 | [JP] | Japan | 56-104645 |
| Jul. 23, 1981 | [JP] | Japan | 56-115587 |
| Aug. 10, 1981 | [JP] | Japan | 56-125017 |
| Aug. 10, 1981 | [JP] | Japan | 56-125018 |
| Apr. 23, 1982 | [JP] | Japan | 57-69061 |

[51] Int. Cl.[3] ..... F25B 41/04

[52] U.S. Cl. ..... 62/200; 62/204; 62/227

[58] Field of Search ..... 62/204, 199, 200, 197, 62/198, 205, 206, 213, 216, 222, 223, 227, 229, 524

[56] References Cited

U.S. PATENT DOCUMENTS

| | | | |
|---|---|---|---|
| 684,894 | 10/1901 | Wolcott | 62/204 |
| 2,048,711 | 7/1936 | Ridge | 62/200 |
| 2,444,593 | 7/1948 | Davis | 62/205 X |
| 2,672,018 | 3/1954 | Jacobs | 62/227 X |

*Primary Examiner*—Harry B. Tanner

*Attorney, Agent, or Firm*—Sughrue, Mion, Zinn, Macpeak, and Seas

[57] ABSTRACT

A cold storage and refrigeration system includes a single refrigerator, a plurality of cold storage and refrigeration units having evaporators, respectively, connected to the refrigerator for passage therethrough of a refrigerant when the refrigerator is in operation, a plurality of temperature sensors installed respectively in the cold storage and refrigeration units for detecting first and second levels of temperature respectively therein, and a control unit responsive to signals supplied from the temperature sensors for controlling the refrigerator in order to energize the latter in response to the detection of the first temperature level by one of the temperature sensors when the refrigerator is de-energized, whereby the refrigerant can flow through the evaporators simultaneously. With this arrangement, the refrigerator can remain de-energized for an increased interval of time during operation of the system, and hence consumes a reduced amount of electric power.

4 Claims, 14 Drawing Figures

COLD STORAGE AND REFRIGERATION SYSTEM

BACKGROUND OF THE INVENTION

The present invention relates to the temperature control of a plurality of cold storage and refrigeration units such as, for example, open cold storage and refrigeration display cases having evaporators, respectively, which are connected to a single refrigerant compressor.

Conventional cold storage and refrigeration systems include a plurality of cold storage and refrigeration units such as display cases and a refrigerator which is energized and de-energized to effect independent temperature control of the display cases. The refrigerator normally remains de-energized for relatively short periods of time in cycles of operation, and hence consumes an increased amount of electric power.

SUMMARY OF THE INVENTION

It is an object of the present invention to provide a cold storage and refrigeration system which will eliminate the difficulties of the prior cold storage and refrigeration system.

Another object of the present invention is to effect temperature control of a cold storage and refrigeration system so that the cold storage and refrigeration units will have temperature curves in substantial conformity with each other, and the refrigerator will remain de-energized for longer periods of time, thereby reducing electrical power consumption.

According to the present invention, a cold storage and refrigeration system comprises a single refrigerator, a plurality of cold storage and refrigeration units having evaporators, respectively, connected to said refrigerator for the passage therethrough of a refrigerant when the refrigerator is in operation, a plurality of temperature sensors installed respectively in the cold storage and refrigeration units for detecting first and second temperature levels respectively therein, and a control unit responsive to signals supplied from the temperature sensors for controlling the refrigerator in order to energize the latter in response to the detection of the first temperature level by one of the temperature sensors when the refrigerator is de-energized, whereby the refrigerant can flow through the evaporators simultaneously. With this arrangement, the refrigerator can remain de-energized for an increased interval of time during operation of the system, and hence consume a reduced amount of electricity.

The above and other objects, features and advantages of the present invention will become more apparent from the following description when taken in conjunction with the accompanying drawings in which certain preferred embodiments of the present invention are shown by way of illustrative example.

DETAILED DESCRIPTION OF THE PREFERRED EMBODIMENTS

Figure 1:
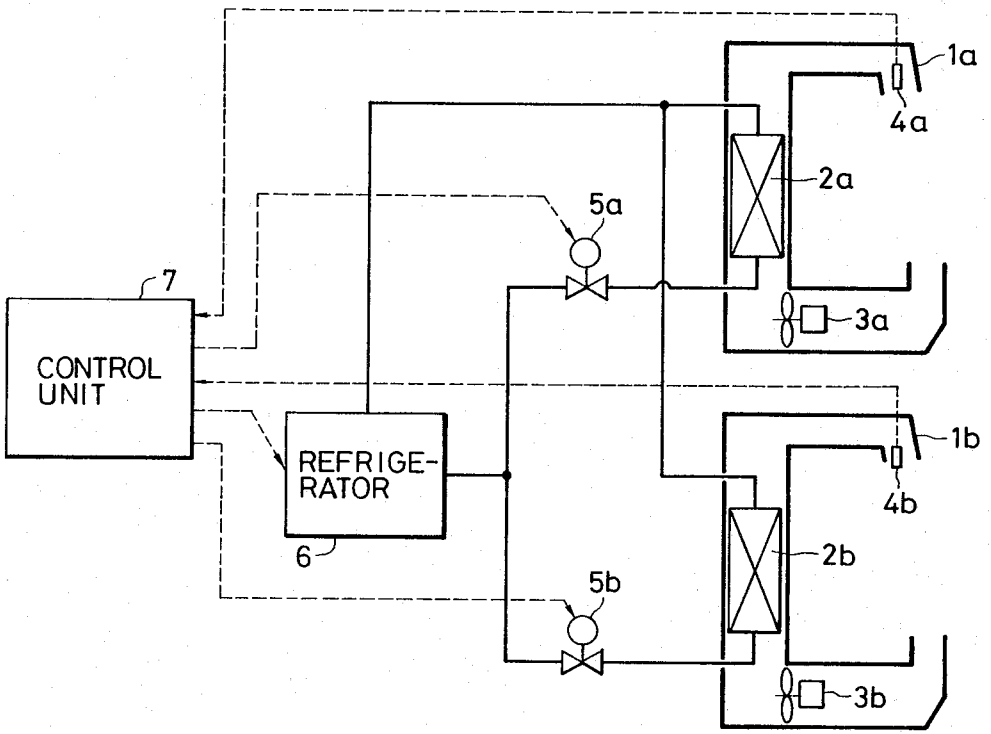
FIG. 1 is a schematic diagram of a cold storage and refrigeration system having a pair of cold storage and refrigeration units, the diagram being illustrative of a refrigerant circulation circuit and a control network.

FIG. 1 shows a conventional refrigeration system having a refrigerant circulation circuit and a control network for a pair of open cold storage and refrigeration display cases 1*a*, 1*b* having front openings for taking goods out of or placing goods into the cases. The display cases 1*a*, 1*b* shown in FIG. 1 are known per se and include outlets disposed upwardly of the openings for discharging cooled air into the display cases and inlets positioned downwardly of the openings for drawing cooled air having passed through the display cases. The display cases 1*a*, 1*b* also have evaporators 2*a*, 2*b*, respectively, located in circulation paths for the cooled air, and air fans 3*a*, 3*b* disposed respectively in the circulation paths for forcing air to circulate through the circulation paths and from the outlets toward the inlets to thereby form air curtains at the front openings in the display cases 1*a*, 1*b*, respectively. The temperatures in the display cases 1*a*, 1*b* are detected respectively by a pair of temperature sensors 4*a*, 4*b* such as thermistors placed in the air outlets of the display cases 1*a*, 1*b*, respectively. A pair of solenoid-operated valves 5*a*, 5*b* are connected in series with the evaporators 2*a*, 2*b*, respectively. The evaporators 2*a*, 2*b* are coupled via the solenoid-operated valves 5*a*, 5*b* with a known refrigerator 6 having a refrigerant compressor, a condensor, a pressure reducing mechanism and the like. A control unit 7 is supplied with signals from the temperature sensors 4a, 4b for energizing and de-energizing the solenoid-operated valves 5a, 5b and the refrigerator 6.

Figure 2:
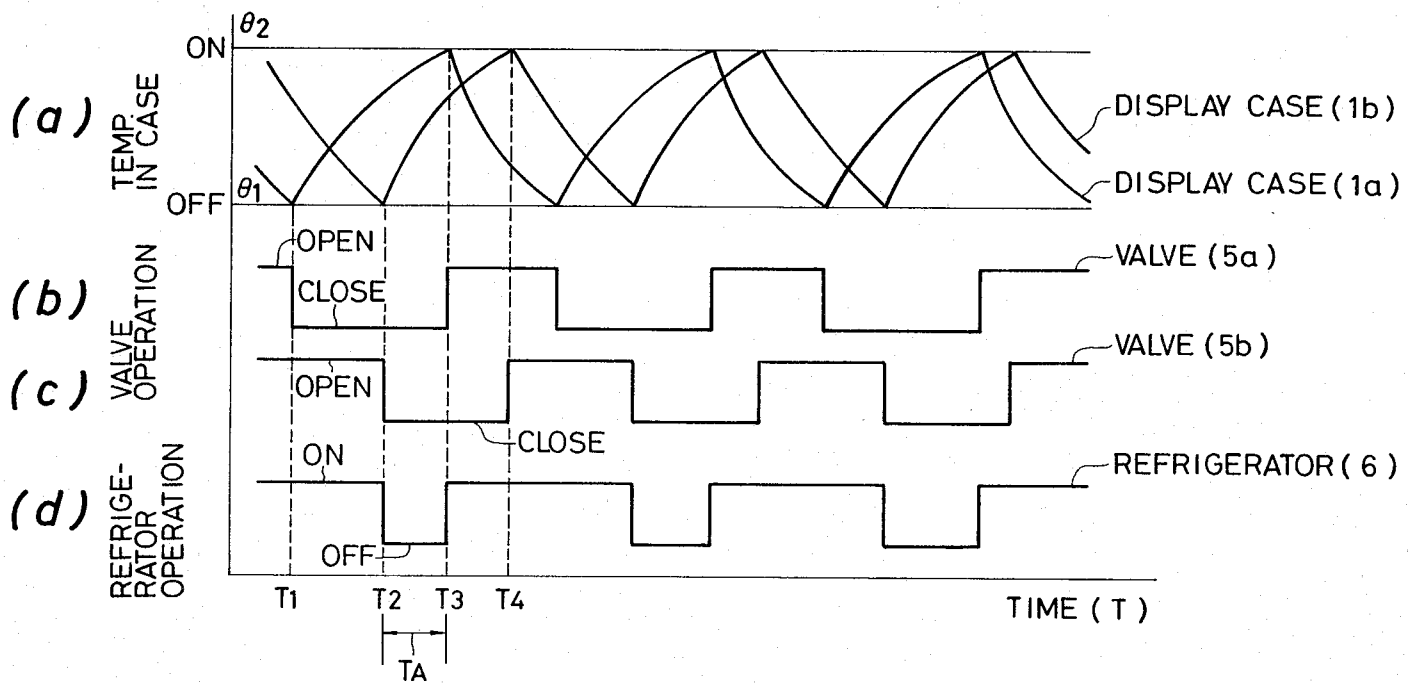
FIG. 2 is a timing chart of the operation of a conventional cold storage and refrigeration system with a pair of cold storage and refrigeration units.

FIG. 2 is a timing chart illustrative of the operation of the known cold storage and refrigeration system shown in FIG. 1. Designated at (a) are variations in the temperatures in the cold storage and refrigeration units or display cases 1a, 1b as detected by the temperature sensors 4a, 4b; and (b) and (c) designate energization and de-energization patterns of the solenoid-operated valves 5a, 5b. Part (d) is the energization and de-energization pattern of the refrigerator 6. As shown in FIG. 2, when the sensor 4a detects a low temperature or OFF temperature level $\theta_1$ at a time $T_1$ while the refrigerator 6 is in operation, the control unit 7 de-energizes the solenoid-operated valve 5a to cause the temperature in the display case 1a to rise. At a time $T_2$, the sensor 4b detects the OFF level $\theta_1$ to enable the control unit 7 to close the solenoid-operated valve 5b, whereupon the refrigerator 6 is de-energized to allow the temperature in the display case 1b to increase. Detection by the sensor 4a of a high temperature or ON temperature level $\theta_2$ at a time $T_3$ causes the control unit 7 to open the solenoid-operated valve 5a and simultaneously energize the refrigerator 6, thus cooling the display case 1a. Likewise, the solenoid-operated valve 5b is energized to cool the display case 1b when the sensor 4b detects the ON level $\theta_2$ at a time $T_4$. The foregoing cycle of operation of the system is repeated for continuous temperature-adjusted refrigeration in the display cases 1a, 1b.

With the conventional cold storage and refrigeration system, the display cases 1a, 1b are independently controlled for temperature, and the refrigerator 6 will be de-energized only when both the solenoid-operated valves 5a, 5b are turned off. The interval of time $T_A$ during which the refrigerator 6 is turned off is sometimes relatively long with the temperature curves of the display cases 1a, 1b being close to each other, but becomes quite short when the temperature curves are "opposite in phase", with the result that the refrigerator 6 remains energized substantially continuously. On the average, therefore, the de-energization time $T_A$ of the refrigerator 6 is relatively short. Furthermore, the electric power consumed by the refrigerator 6 remains substantially the same irrespective of whether both the display cases 1a, 1b are being cooled, or only one of the display cases 1a, 1b is being cooled. Thus, the prior cold storage and refrigeration system consumes a relatively large amount of electricity.

The more display cases to be temperature-controlled, the less frequently the refrigerator is enabled to be turned off, and the shorter the time interval $T_A$, resulting in larger electric power consumption.

Figure 3:
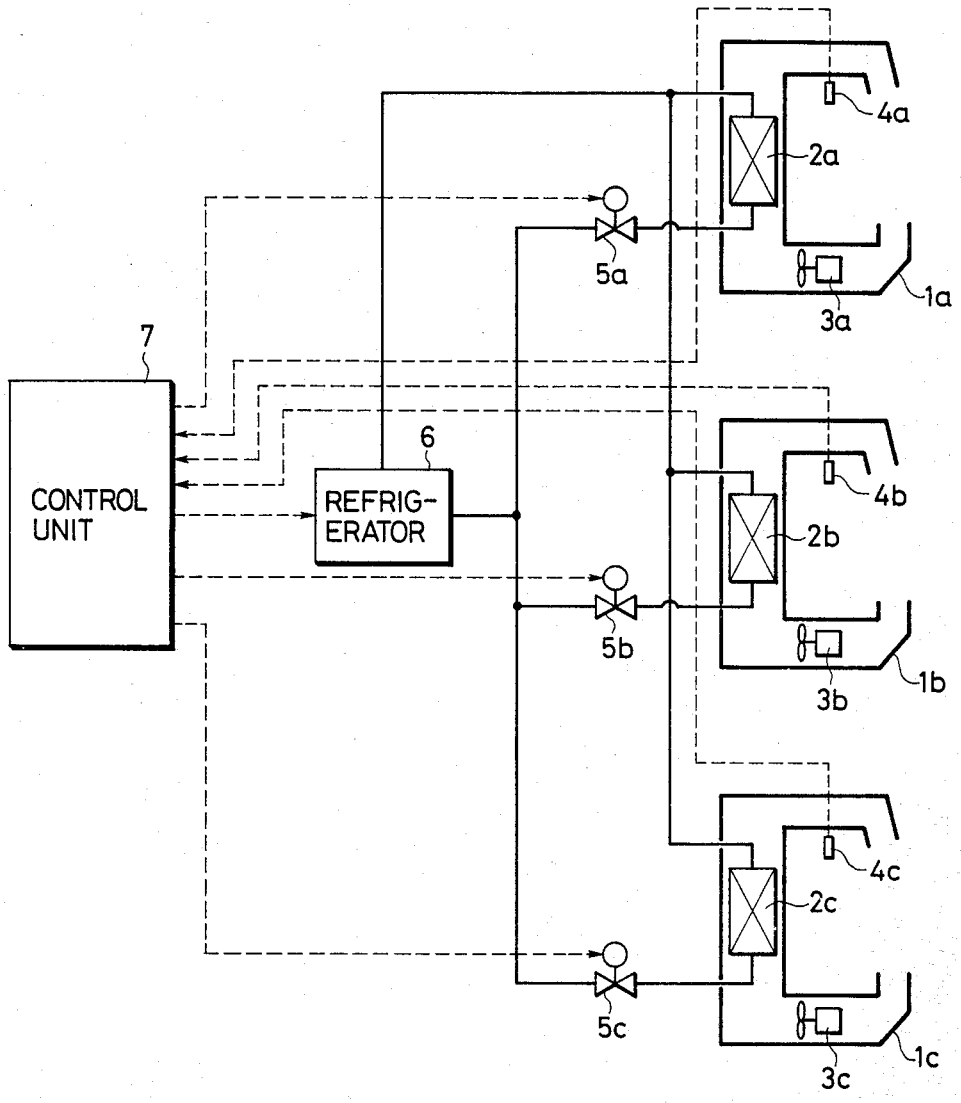
FIG. 3 is a schematic diagram of a cold storage and refrigeration system including three cold storage and refrigeration units, a refrigerant circulation circuit, and a control network.
Figure 4:
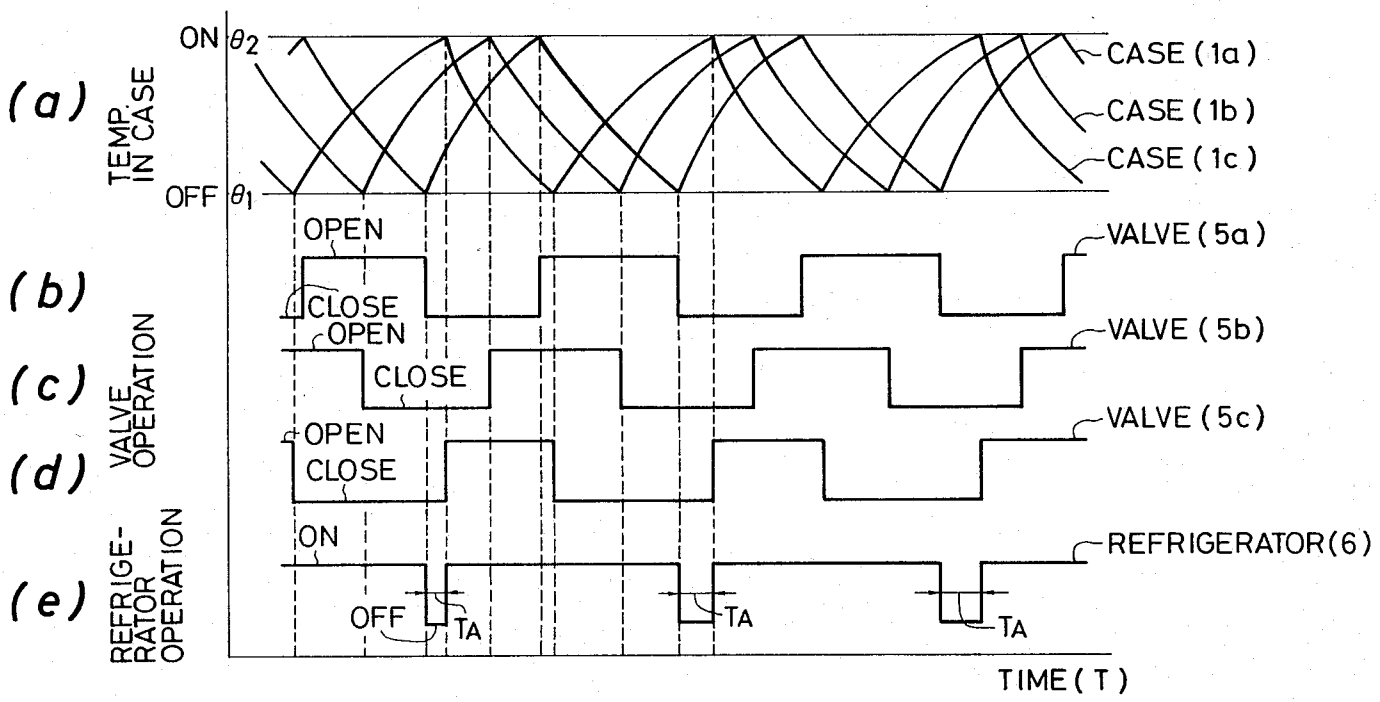
FIG. 4 is a timing chart of the operations of a conventional cold storage and refrigeration system with three cold storage and refrigeration units.

FIG. 3 is illustrative of a cold storage and refrigeration system including three display units 1a, 1b, 1c having evaporators 2a, 2b, 2c, respectively, and temperature sensors 4a, 4b, 4c, respectively. The system also comprises solenoid-operated valves 5a, 5b, 5c by which the evaporators 2a, 2b, 2c are coupled to a refrigerator 6 controlled by a control unit 7. In FIG. 4, designated at (a) are variations in the temperatures in the display cases 1a–1c as detected by temperature sensors 4a–4c; and at (a), (c), (d) are energization and de-energization patterns of the solenoid-operated valves 5a–5b. The pattern of energization and de-energization of the refrigerator 6 is shown at (e). A study of FIG. 4 indicates that the time interval $T_A$ is shorter than that shown in FIG. 2, and hence the refrigerator 6 consumes a greater amount of electric power.

The present invention will now be described with respect to its preferred embodiments.

A cold storage and refrigeration system according to a first embodiment will be described with reference to FIGS. 1, 5 and 6. The cold storage and refrigeration system is substantially the same as the conventional system except for the control unit 7. The control unit 7 is responsive to detection by either of the temperature sensors 4a or 4b of the ON temperature level $\theta_1$ for energizing the refrigerator 6 and both the solenoid-operated valves 5a, 5b to allow the refrigerant to flow through the evaporator 2a, 2b. As with the prior cold storage and refrigeration system, the solenoid-operated valve 5a or 5b is opened when the sensor 4a or 4b detects the OFF level, thus permitting the refrigerant to pass through the evaporator 2a or 2b, and the compressor in the refrigerator 6 is de-energized when both the solenoid-operated valves 5a, 5b are opened and both the evaporators 3a, 2b are put into operation.

Figure 5:
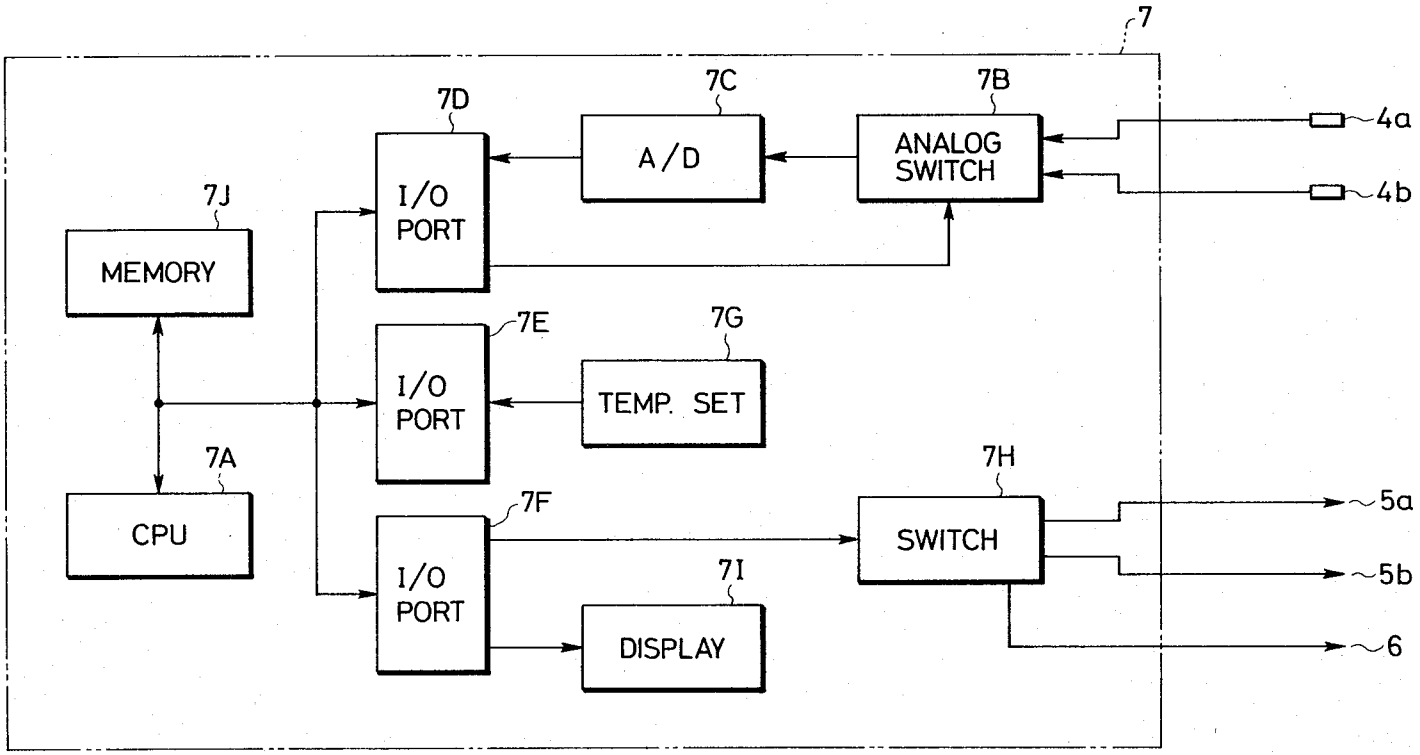
FIG. 5 is a block diagram of a control apparatus for a cold storage and refrigeration system according to a first embodiment of the present invention.

As shown in FIG. 5, the control unit 7 compriese a central processing unit (CPU) 7A, an analog switch 7B, an analog-to-digital converter 7C, a first input/output port 7F, a unit 7G for setting temperatures in the display cases 1a, 1b to be controlled, an electric signal switching unit 7H, a display unit 7I composed of diodes and the like, and a memory 7J in which a control program is stored. The control program will be described with reference to the description of the operation of the control unit 7, which will be given below.

The control unit 7 thus constructed will operate as follows: For ease of explanation, the following description is based on the assumption that the display case 1a is subjected to a lower load and the display case 1b to a higher load with the thermal energy introduced into the display case 1a through the air curtain created at the front opening thereof by the air fan 3a being smaller than that introduced into the display case 1b through the air curtain generated at the front opening thereof by the air fan 3b. Temperature data items supplied from the temperature sensors 4a, 4b attached to the display cases 1a, 1b to be controlled are selected by the analog switch 7B, and are converted by the analog-to-digital converter 7C into a digital signal, which is then delivered via the first input/output port 7D to the central processing unit 7A. Settings for effecting and stopping temperature adjustment for the controlled cases 1a, 1b are established using the temperature setting-unit 7G, and are supplied through the second input/output port 7E to the central processing unit 7A. The data items indicative of the temperatures in the cases 1a, 1b, and the ON and OFF settings for temperature adjustment undergo arithmetic operations determined by the control program stored in the memory 7J.

More specifically, while the refrigerator 6 is de-energized with the display cases 1a, 1b under the above given thermal conditions, the temperature rise is faster for the case 1b than for the case 1a. When the sensor 4b detects the ON level $\theta_2$ set by the temperature setting unit 7G, or when the controlled case 1b is at an increased temperature and needs to be cooled by energizing the refrigerator 6, the central processing unit 7A issues a control signal to the third input/output port 7F. This control signal is delivered via the third input/output port 7F to the switch unit 7H, in which relays, etc. are controlled to energize the solenoid-operated valves 5a, 5b simultaneously to turn on the refrigerator 6. At the same time, the control signal enables the display unit 7I to display the operation condition at the time.

The refrigerant is now allowed to flow through the evaporators 2a, 2b to start cooling the cases 1a, 1b. As a result, the temperatures in the cases 1a, 1b as detected by the sensors are lowered substantially in synchronism as illustrated in FIG. 6 at (a). In FIG. 6, designated at (a) are variations in the temperatures in the controlled units 1a, 1b as detected by temperature sensors 4a, 4b. Parts (b) and (c) are energization and de-energization patterns of the solenoid-operated valves 5a, 5b, and (d) illustrates the energization/de-energization pattern of the refrigerator 6. As time goes on, the sensor 4a in the lightly loaded case 1a detects the OFF level $\theta_1$ set by the temperature setting unit 7G when the temperature in the controlled case 1a is sufficiently lowered and no longer needs to be further cooled. The central processing unit 7A then delivers a control signal to the third input/output port 7F. The control signal is supplied via the third input/output port 7F to the switch unit 7H in which relays are controlled to thereby close the solenoid-operated valve 5a coupled with the case 1a. Simultaneously, the control signal enables the display unit 7I to indicate the operation condition at the time. Therefore, the cooling capacity of the evaporator 2b is increased to the point where the sensor 4b soon detects the OFF level $\theta_1$ at a time $T_7$, whereupon the central processing unit 7A outputs to a third input/output port 7F a control signal which controls the relay, etc. in the switch unit 7H to close the solenoid-operated valve 5b for the case 1b and stop the refrigerator 6. The display unit 7I simultaneously displays this condition.

After the solenoid-operated valves 5a, 5b have been closed, the temperature rises more slowly in the lightly loaded case 1a than in the case 1b. When the sensor 4b in the case 1b detects the ON level $\theta_2$ at a time $T_8$, the evaporators 2a, 2b enter the cooling mode synchronously at the same time as described above. The cold storage and refrigeration system now repeats the foregoing operation.

In the operation of the system of the above embodiment, the sensor 4a may detect the ON level $\theta_2$ as the load in the cases changes with time due to variations in the displayed goods and the ambient temperature. Even in such a condition, the evaporators 2a, 2b start cooling the cases 1a, 1b concurrently, with the result that the temperature curves of the cases 1a, 1b become quite close to each other as shown at (a) in FIG. 6. With the independent temperature curves of the cases 1a, 1b of the conventional system as shown at (a) in FIG. 2, the average time $T_A$ in which the compressor in the refrigerator 6 is de-energized is much shorter than the interval of time $T_B$ (FIG. 6) of the de-energization of the compressor as controlled by the control unit 7 shown in FIG. 5. Thus, the compressor in the system according to the first embodiment of the present invention remains de-energized for the longer time interval $T_B$, resulting in greatly reduced power consumption.

The system according to the first embodiment is also advantageous in that the evaporators 2a, 2b are simultaneously in operation in most of the cooling mode, and as a result, the performance coefficient or efficiency of the refrigerator 6 is high during such time, adding to a further reduction in the electric power consumed.

With the conventional cold storage and refrigeration system, the de-energization time interval $T_A$ of the compressor becomes shorter as the number of display cases connected to the refrigerator 6 is increased. According to the first embodiment of the invention, however, since the display cases 1a, 1b start to be cooled simultaneously, the time interval $T_B$ of de-energization of the compressor is not reduced to a large extent even with the number of display cases to be controlled being increased, and hence an increased number of display cases can efficiently be controlled by the single refrigerator 6.

Figure 6:
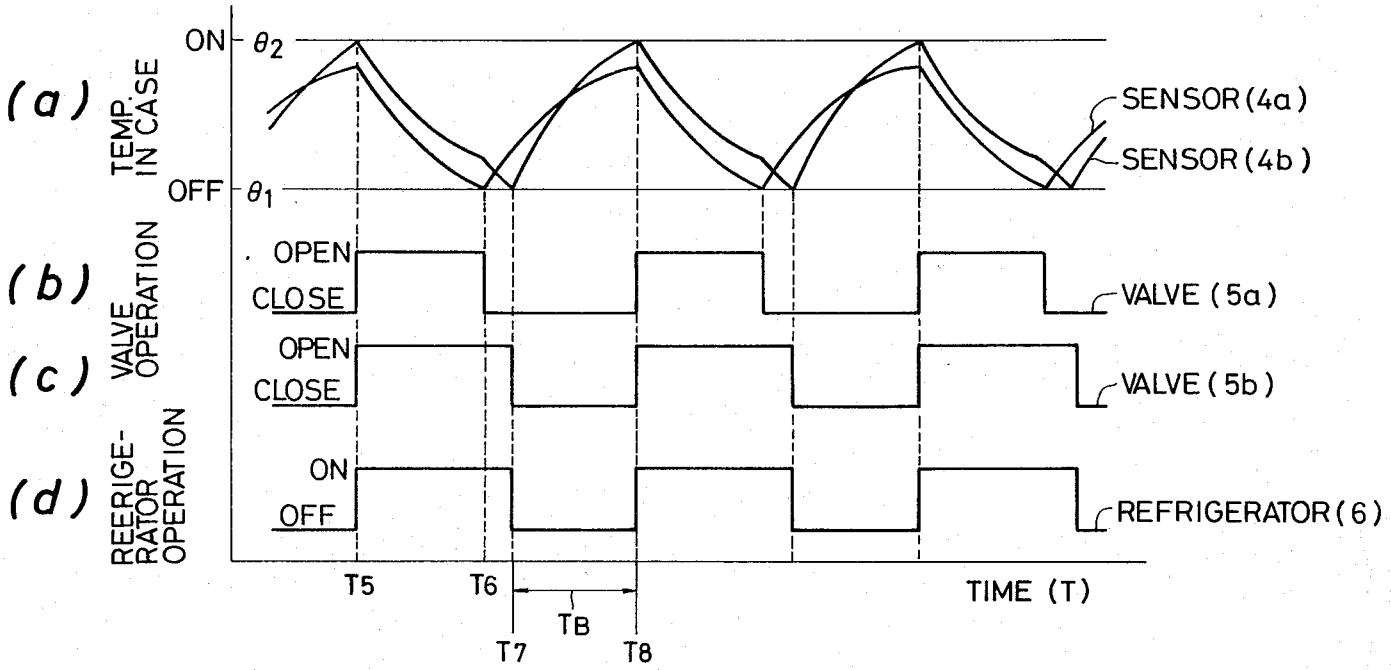
FIG. 6 is a timing chart illustrative of the operations of the cold storage and refrigeration system controlled by the control apparatus shown in FIG. 5.

Another advantage with the cold storage and refrigeration system according to the first embodiment is that the case 1a is temperature-controlled within a smaller temperature range than the full temperature range between the ON level $\theta_2$ and the OFF level $\theta_1$ as shown at (a) in FIG. 6, while the case 1b is controlled to traverse the full temperature range. On the other hand, both the cases 1a and 1b of the known system vary the full temperature range defined between the ON and OFF levels, as illustrated at (a) in FIG. 2. While in the illustrated first embodiment the display cases 1a, 1b are controlled by the same ON level $\theta_2$ and OFF level $\theta_1$, the ON and OFF levels for the case 1a may preferably be set differently from those for the case 1b where the cases 1a, 1b display different goods and hence are to be controlled for varied temperatures. As a further modification, the sensors 4a, 4b may be located within the cases 1a, 1b instead of in the air outlets.

Figure 7:
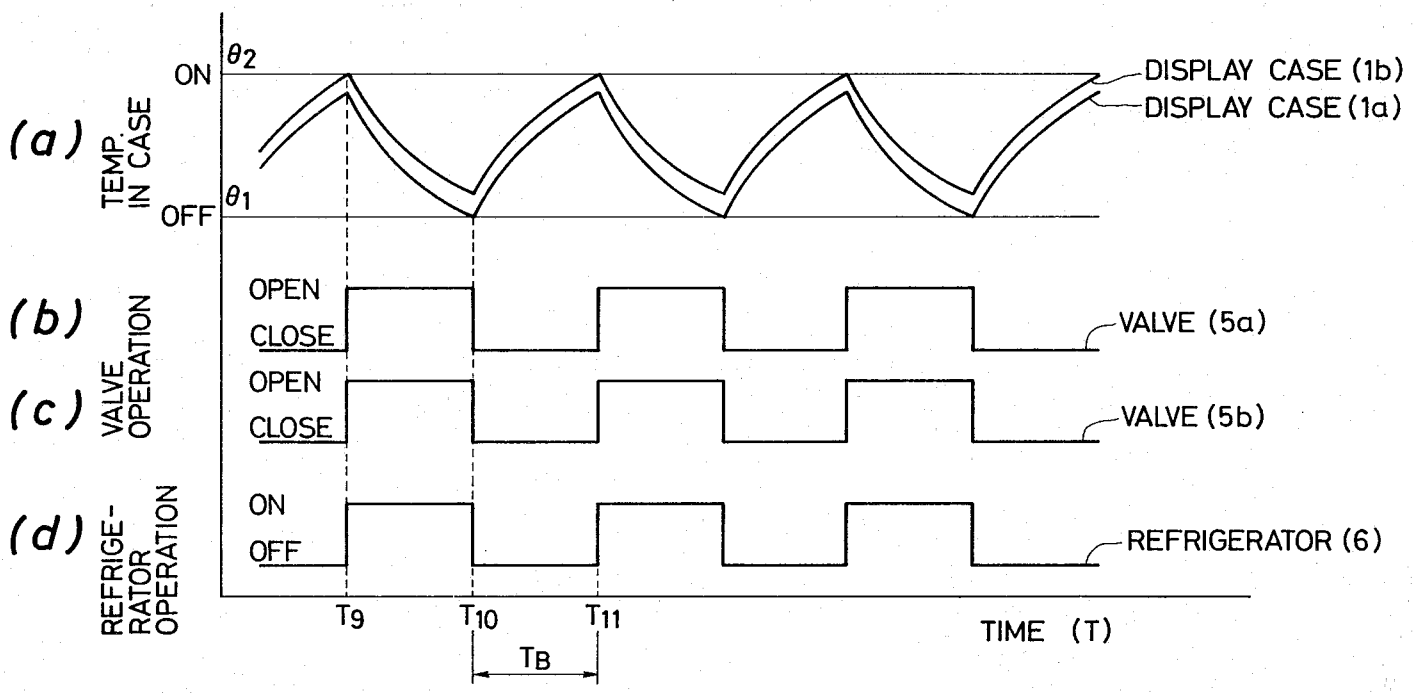
FIG. 7 is a timing chart showing the operations of a cold storage and refrigeration system controlled by a control apparatus according to a second embodiment of the present invention.

A second embodiment of the present invention will now be described with reference to FIGS. 1, 5 and 7. The cold storage and refrigeration system according to the second embodiment is substantially of the same construction as that of the conventional system, except for the control unit 7. The control unit 7 according to the second embodiment effects the same control for starting the refrigerator 6 when the latter is turned off as that carried out by the control unit 7 according to the first embodiment, but performs a different controlling operation for de-energizing the refrigerator 6 when the latter is in operation. More specifically, when one of the sensors 4a, 4b detects the OFF level $\theta_1$ while the refrigerator 6 is being operated, the control unit 7 closes the solenoid-operated valves 5a, 5b and de-energizes the refrigerator 6. Conversely, when one of the sensors 4a, 4b detects the ON level $\theta_2$ while the refrigerator 6 is de-energized, the control unit 7 opens the solenoid-operated valves 5a, 5b and energizes the refrigerator 6, allowing the refrigerant to the flow through the evaporators 2a, 2b simultaneously.

The control unit 7 according to the second embodiment is of the same construction as that of the control unit 7 of the first embodiment, but is controlled by a different control program stored in the memory 7J. The control program will be understood from the following description of the operation of the cold storage and refrigeration system.

The operation of the system according to the second embodiment will now be described with reference to FIGS. 1, 5 and 7, it being assumed that the display case 1a is subjected to a lower load and the display case 1b to a higher load, with thermal energy introduced into the display case 1a through the air curtain created at the front opening thereof being smaller than that introduced into the display case 1b. The data items on the temperatures in the controlled cases 1a, 1b, and the ON and OFF settings for temperature adjustment, which have been supplied in the same manner as that of the first embodiment, undergo arithmetic operations determined by the control program stored in the memory 7J.

More specifically, while the refrigerator 6 is deenergized with the display cases 1a, 1b under the above described thermal conditions, the temperature rise in faster in the heavily loaded case 1b than in the case 1a.

When the sensor 4b detects the ON level $\theta_2$ at a timne $T_9$, the central processing unit 7A issues a control signal to the third input/output port 7F, which is delivered to the switch unit 7H, is controlled to energize the solenoid-operated valves 5a, 5b simultaneously to turn on the refrigerator 6. At the same time, the control signal enables the display unit 7I to display the operating condition at the time. The refrigerant is now allowed to flow through the evaporators 2a, 2b to start cooling the cases 1a, 1b. As a result, the temperatures in the cases 1a, 1b, as detected by the sensors, are lowered substantially in synchronism as illustrated in FIG. 7 at (a). FIG. 7 shows at parts (a), (b), (c) and (d) thereof variations in the temperatures in the controlled units 1a, 1b as detected by temperature sensors 4a, 4b; energization and de-energization patterns of the solenoid-operated valves 5a, 5b; and the energization and de-energization pattern of the refrigerator 6. During the cooling process, the temperature in the lightly loaded case 1a is lowered more rapidly than the case 1b. When the sensor 4a detects the OFF level $\theta_1$ at a time $T_{10}$, the central processing unit 7A outputs to the third inout/output port 7F a control signal which controls the relay in the switch unit 7H to close the solenoid-operated valves 5a, 5b for the case 1b and stop the refrigerator 6. The display unit 7I simultaneously displays this condition.

After the solenoid-operated valves 5a, 5b have been closed, the temperature rises more slowly in the lightly loaded case 1a than in the case 1b. When the sensor 4b in the heavily loaded case 1b detects the ON level $\theta_2$ at a time T11, the evaporators 2a, 2b enter the cooling mode synchronously at the same time as described above. The refrigeration system now repeats the foregoing operation. The system according to the second embodiment is more advantageous than the system according to the first embodiment in that both the cases 1a, 1b can be controlled within temperature ranges smaller than the full range defined between the ON level $\theta_2$ and the OFF level $\theta_1$, while only the case 1a in the system of the first embodiment is temperature-controllable in the smaller temperature range. Where the cases 1a, 1b in the system of the second embodiment should be controlled to different temperatures for the reason that they contain different goods, the ON level $\theta_2$ and the OFF level $\theta_1$ for the case 1a should preferably be different from those for the case 1b. Furthermore, the solenoid-operated valves 5a, 5b may be replaced with a single solenoid-operated valve disposed in a pipe connected directly with the refrigerator 6, or alternatively may be dispensed with entirely where the cases 1a, 1b are located close to the refrigerator 6. With these modifications, the control unit 7 is then arranged such that it will control a single solenoid-operated valve or no such solenoid-operated valves whatsoever. Furthermore, the sensors 4a, 4b may be positioned within the cases 1a, 1b, respectively, instead of in the air outlets thereof.

Figure 8:
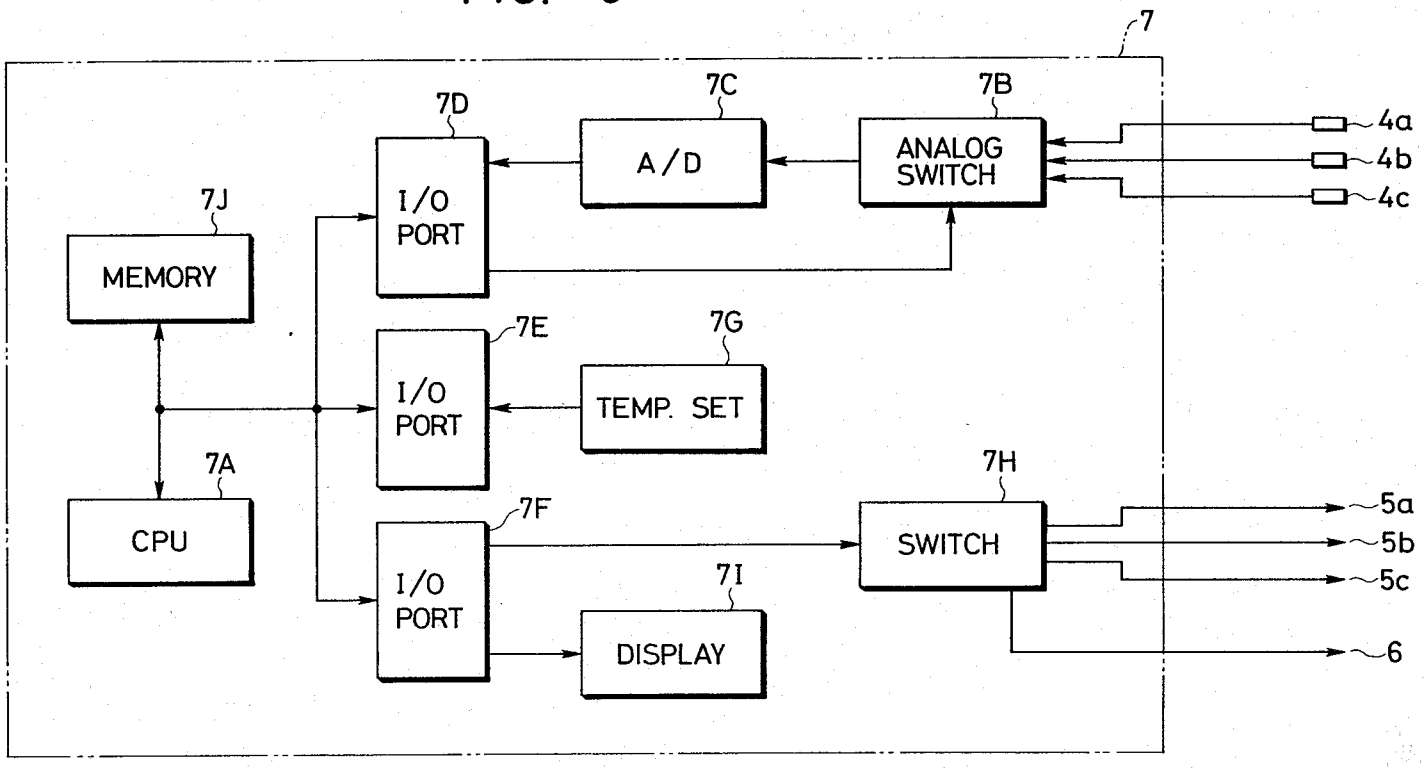
FIG. 8 is a block diagram of a control apparatus for a cold storage and refrigeration system constructed in accordance with a third embodiment of the present invention.
Figure 9:
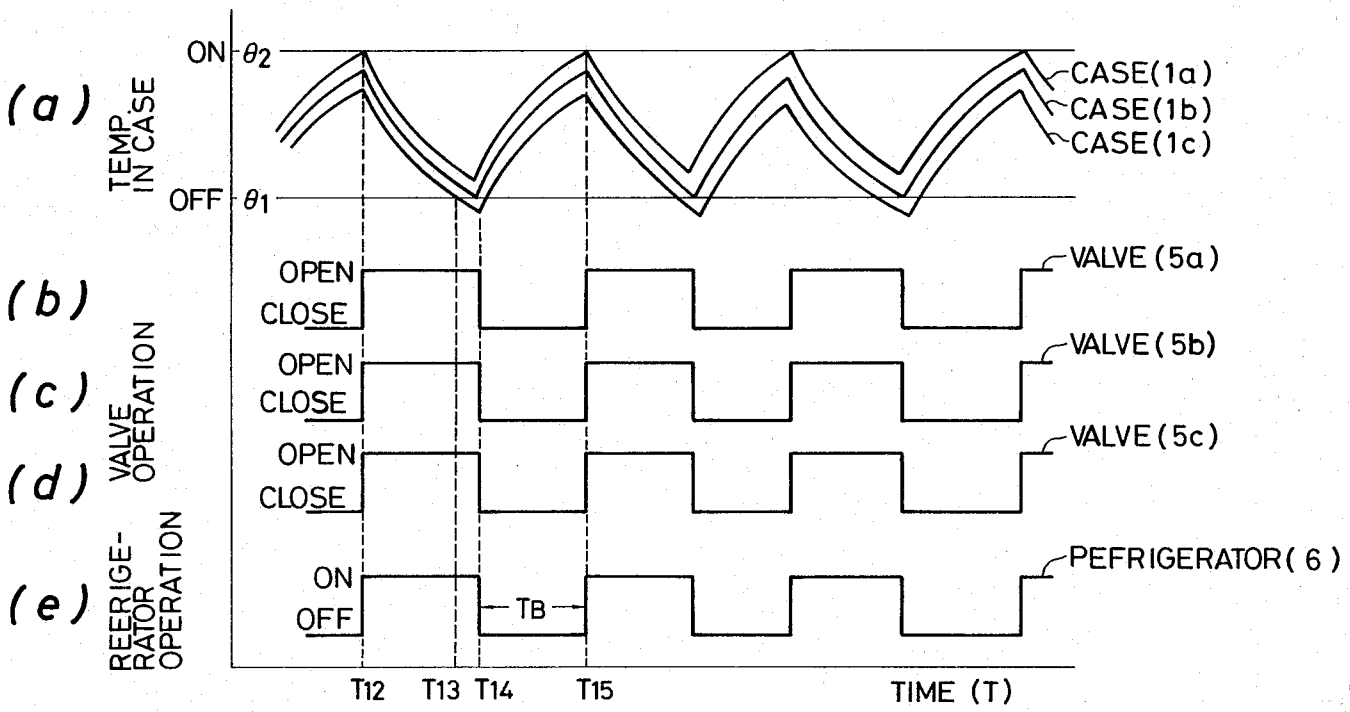
FIG. 9 is a timing chart explanatory of the operations of the cold storage and refrigeration system controlled by the control apparatus of the third embodiment.

A third embodiment of the present invention will now be described with reference to FIGS. 3, 8 and 9. The cold storage and refrigeration system according to this embodiment is of substantially the same construction as that of the coventional system again, except for the control unit 7. The control unit 7 according to the third embodiment effects the same control for starting the refrigerator 6 when the latter is turned off as that carried out by the control unit 7 according to the first and second embodiments, but performs a different controlling operation for de-energizing the refrigerator 6 when the latter is in operation.

More specifically, when one of the sensors 4b for the controlled case 1b, for example, which is subjected to a medium load, detects the OFF level $\theta_1$ during operation of the refrigerator 6, the control unit 7 closes the solenoid-operated valves 5a, 5b, 5c and stops the refrigerator 6. Conversely, when one of the sensors 4a, 4b detects the ON level $\theta_2$ while the refrigerator 6 is de-energized, the control unit 7 opens the solenoid-operated valves and energizes the refrigerator 6, allowing the refrigerant to flow through the evaporators simultaneously.

The control unit 7 according to the third embodiment is of the same construction as that of the control unit 7 of the first and second embodiments, but is controlled by a different control program stored in the memory 7J. The control program will be understood from the following description of the operation of the system.

The operation of the system according to the third embodiment will now be described with reference to FIGS. 3, 8 and 9. For ease in explanation, the following description is based on the assumption that the display cases 1a, 1b, 1c are subjected to higher, medium and lower loads, respectively. The data items respecting the temperatures in the controlled cases 1a, 1b and the ON and OFF settings for temperature adjustment, which have been supplied in the same manner as in the first embodiment, undergo arithmetic operations as determined by the control program stored in the memory 7J.

More specifically, while the refrigerator 6 is deenergized with the display cases under the above thermal conditions, the temperature rise in faster for the most heavily loaded case 1a. When the sensor 4a for the case 1a detects the ON level $\theta_2$ at a time T12, the central processing unit 7A issues a control signal to the third input/output port 7F, which is delivered thereby to the switch unit 7H, in which relays are controlled to energize the solenoid-operated valves 5a, 5b, 5c simultaneously and to turn on the refrigerator 6. At the same time, the control signal enables the display unit 7I to display the operating condition. The refrigerant flows through the evaporators 2a, 2b, 2c to start cooling the cases. As a result, the temperatures in the cases 1a, 1b, 1c as detected by the sensors are lowered substantially in synchronism as illustrated in FIG. 9 at (a). In FIG. 9, variations in the temperatures in the controlled units 1a, 1b, 1c as detected by temperature sensors 4a, 4b, 4c; energization and de-energization patterns of the solenoid-operated valves 5a, 5b, 5c, and the pattern of energization and de-energization of the refrigerator 6 are shown in parts (a)–(d), respectively. During such cooling process, the temperature in the lightly loaded case 1c is lowered relatively rapidly. When the sensor 4c for the case 1c detects the OFF level $\theta_1$ at a time $T_{13}$, the central processing unit 7A does not deliver a control signal to the third input/output port 7F for actuating the solenoid-operated valve 5c. Thus, the solenoid-operated valve 5c for the most lightly loaded case 1c is not closed even when the sensor 4c therefor detects the OFF level $\theta_1$, allowing the case 1c to be further cooled. As time goes on, the sensor 4b in the case 1b detects the OFF level $\theta_1$ at a time $T_{14}$, whereupon the central processing unit 7A delivers a control signal to the third input/output port 7F for controlling the refrigerator 6 and the solenoid-operated valves 5a, 5b, 5c. The supplied control signal goes through the third input/output port 7F to the switch unit 7H, in which the control signal controls the relays and other parts thereof to close the solenoid-operated valves 5*a*, 5*b*, 5*c* and stop the refrigerator 6. The control signal also serves to indicate the status on the display unit 7I.

After the solenoid-operated valves 5*a*, 5*b*, 5*c* have been closed, the temperature rises relatively slowly in the most lightly loaded case 1*c*. When the sensor 4*a* in the most heavily loaded case 1*a* detects the ON level $\theta_2$ at a time $T_{15}$, the evaporators 2*a*, 2*b*, 2*c* enter the cooling mode synchronously at the same time as described above. The system then repeats the foregoing operation. The cold storage and refrigeration system according to this embodiment is more advantageous than the systems according to the first and second embodiments in that the cooling operation is stopped when the sensor 4*b* for the medium loaded case 1*b* detects the OFF level $\theta_1$, and hence the lower limits of the temperatures of the thres cases are in the vicinity of the OFF level $\theta_1$, an arrangement which is more effective to permit the displayed goods to keep for a longer period of time. For maintaining the maximum de-energization time interval $T_B$ of the refrigerator 6, however, the refrigerator 6 should be de-energized at the time $T_{13}$ when the sensor 4*c* detects the OFF level $\theta_1$. But, in order to meet the demand for more reliable refrigeration of the displayed goods while sacrificing energy savings, the refrigerator 6 should be de-energized when the OFF level $\theta_1$ is detected by the sensor 4*a* for the most heavily loaded case 1*a*.

While in the third embodiment, the ON level $\theta_2$ and the OFF level $\theta_1$ are the same for all of the cases 1*a*, 1*b*, 1*c*, the latter may have different ON and OFF levels where the optimum temperatures for storing the displayed goods vary from case to case. Although the sensors 4*a*–4*c* have been shown as being positioned for direct detection of temperatures in the cases, they may be located in either the air inlets or outlets to detect temperatures indirectly. Alternatively, a plurality of temperature sensors may be provided for each case so that-the average value of the sensor outputs may be used as the detected signal. While in the third embodiment the solenoid-operated valves 5*a*, 5*b*, 5*c* are coupled respectively with the evaporators 2*a*, 2*b*, 2*c*, a single solenoid-operated valve may instead be disposed in a pipe connected directly to the refrigerator 6. The solenoid-operated valves may entirely be dispensed with where the refrigerator 6 is installed close to the cases 1*a* through 1*c*.

Figure 11:
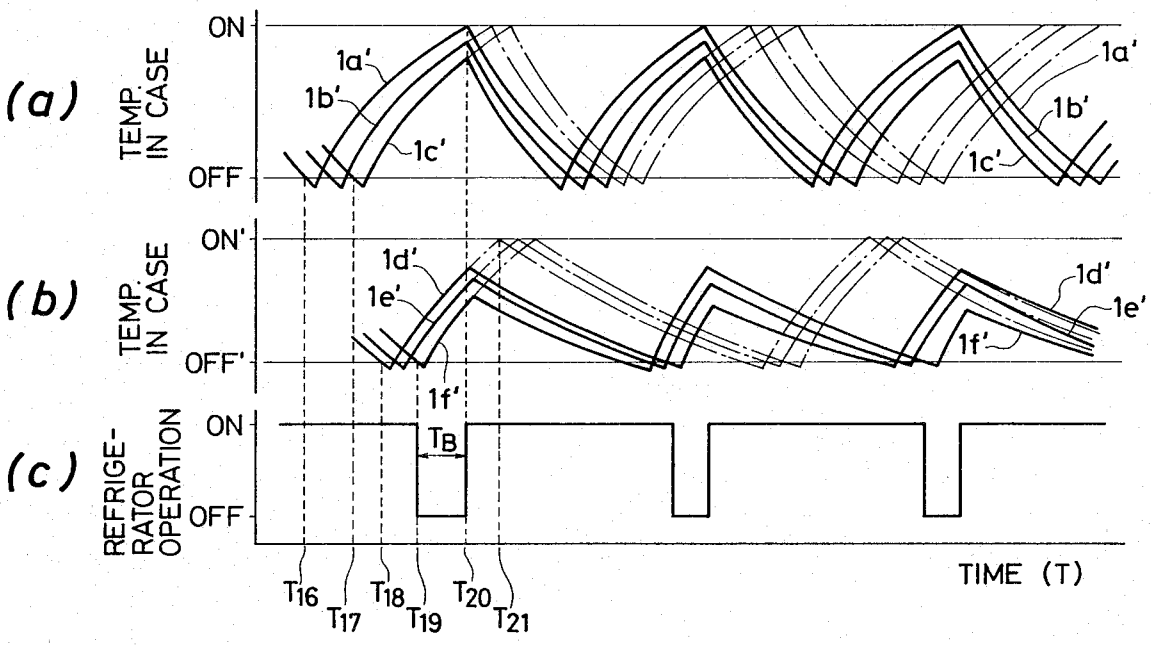
FIG. 11 is a timing chart for the operation of the cold storage and refrigeration system controlled by the control apparatus according to the fourth embodiment.
Figure 12:
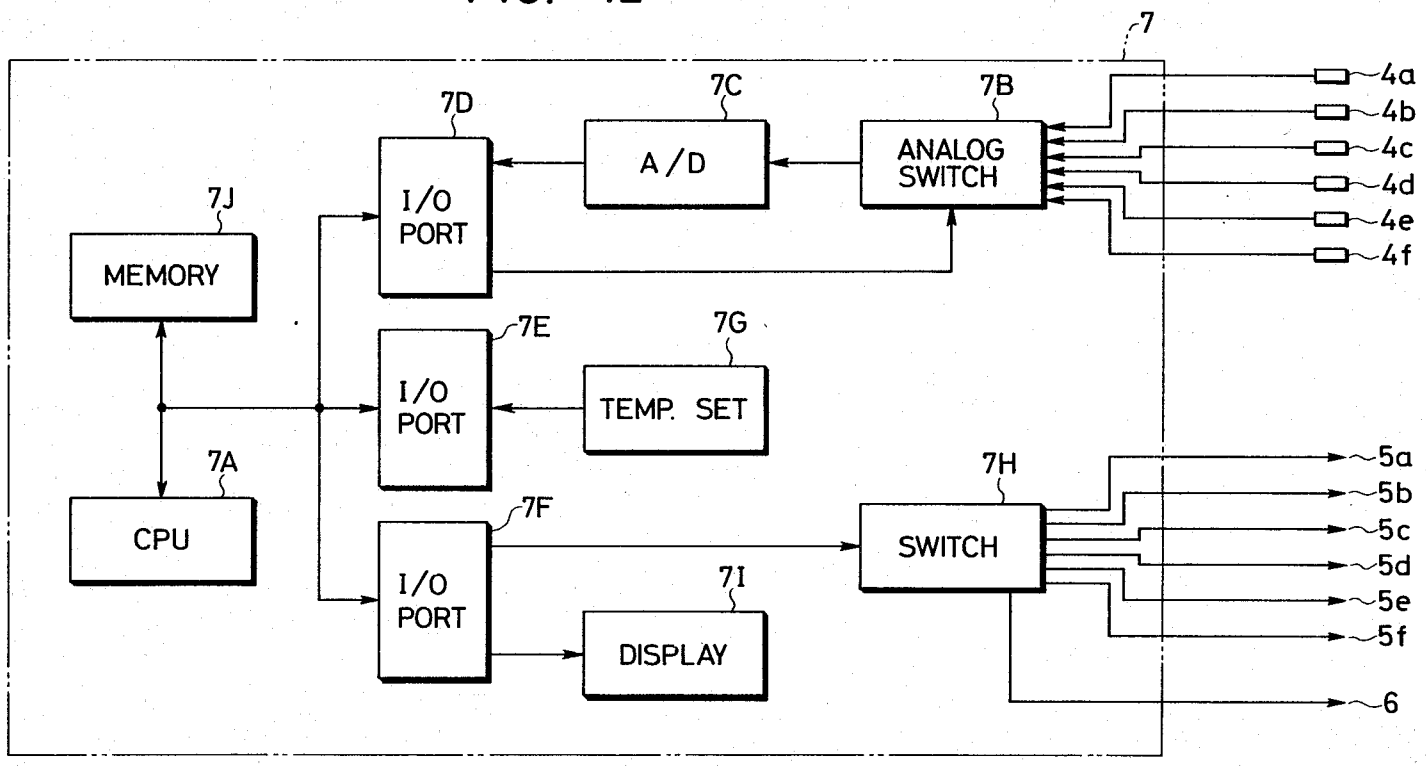
FIG. 12 is a block diagram of a control apparatus for the cold storage and refrigeration system according to the fourth embodiment.

A cold storage and refrigeration system according to a fourth embodiment will now be described with reference to FIGS. 10, 12 and 13. The system according to the fourth embodiment is an improvement over the system of the first embodiment. The system shown in FIG. 10 has six cold storage and refrigeration units such as display cases, and includes evaporators 2*a* through 2*f* disposed in the refrigeration units, respectively, expansion valves 6*a* through 6*f* coupled respectively with the evaporators 2*a* through 2*f*, solenoid-operated valves 5*a* through 5*f* for controlling the evporators 2*a* through 2*f*, respectively, temperature sensors 4*a* through 4*f* located directly in the cases or in the cooled-air inlets thereof for detecting the temperatures in the display cases, a refrigerator 6, a control unit 7 responsive to temperature-indication signals from the temperature sensors 4*a* through 4*f* for producing output signals for energizing and de-energizing the solenoid-operated valves 5*a* through 5*f* and the refrigerator 6, and a condenser 8 connected between the evaporators 2*a* through 2*f* and the refrigerator 6. It is assumed that the display cases having the evaporators 2*a* through 2*c* are loaded relatively lightly, and those having the evaporators 2*d* through 2*f* are loaded relatively heavily. FIG. 11 shows a control operation in which the thus differently loaded display cases are controlled by the control unit according to the first embodiment. Designated at (a) and (b) are the variations in the temperatures in the display cases 1*a*′ through 1*f*′ having the evaporators 2*a* through 2*f*, respectively, as detected by the temperature sensors, and (c) represents an energization/de-energization pattern of the refrigerator 6. Also designated at ON and OFF are temperature settings for energizing and de-energizing the solenoid-operated valves 5*a*, 5*b*, 5*c* for the relatively lightly loaded display cases, and ON′ and OFF′ are the the temperature settings for energizing and de-energizing the solenoid-operated valves 5*d*, 5*e*, 5*f* for the relatively heavily loaded display cases.

In operation, the lightly loaded display cases 1*a*′, 1*b*′, 1*c*′ have phase differences between the temperature changes and reach the OFF level successively due to such temperature phase differences, whereupon the solenoid-operated valves 5*a*, 5*b*, 5*c* are closed to cause the temperatures in the display cases 1*a*′, 1*b*′, 1*c*′ to increase after they have dropped slightly below the OFF level. At this time, the temperatures in the display cases 1*a*′, 1*c*′ reach the OFF level at times $T_{16}$, $T_{17}$, respectively. Thereafter, the temperatures in the display cases 1*d*′, 1*e*′, 1*f*′ reach the OFF′ level in succession, whereupon the corresponding solenoid-operated valves 5*d*, 5*e*, 5*f* are closed to allow the temperatures in the display cases 1*d*′, 1*e*′, 1*f*′ to increase. At this time, the temperatures in the display cases 1*d*′, 1*f*′ reach the OFF′ level at times $T_{18}$, $T_{19}$, respectively, which are generally later than the time $T_{17}$. The refrigerator 6 starts operating when any one of the solenoid-operated valves is opened, so that it stops at the time $T_{19}$ when all of the solenoid-operated valves are closed, starts to operate at the time $T_{20}$ when the solenoid-operated valve 5*a* is opened, and remains de-energized during the time interval $T_B$ between the times $T_{19}$ and $T_{20}$. With a conventional cold storage and refrigeration system, the temperatures in the display cases 1*a*′ through 1*f*′ then vary as in the patterns shown by the dot-and-dash lines in FIG. 11, and the refrigerator 6 keeps operating, as there is no time at which all of the solenoid-operated valves 5*a* through 5*f* are closed in FIG. 11. The control unit according to the first embodiment causes the solenoid-operated valves 5*a* through 5*f* to open at the time $T_{20}$ when the solenoid-operated valve 5*a* is opened, to bring the times at which the temperatures reach the OFF and OFF′ levels into as much conformity with each other as possible. With the solenoid-operated valves 5*a* through 5*f* thus controlled, the temperatures in the display cases follows the curves shown in the solid lines in FIG. 11, and an operating pattern in which the refrigerator 6 can be de-energized for at least the time interval $T_B$ in each cycle of operation is established, resulting in savings in the electric power consumed by the refrigerator 6.

The foregoing operation has been substantially described with reference to the description of the first embodiment. Where the control unit according to the first embodiment is used for controlling a system with a plurality of differently loaded display units, however, there is a tendency for the system to suffer from the following difficulty. As shown in FIG. 11, the temperature in the display case 1*d*′ does not reach the ON′ level at the time $T_{20}$. If the temperature in the display case 1*d*′ reached the ON' level at a time $T_{21}$, the solenoid-operated valves 5*d*, 5*e*, 5*f*, for the relatively heavily loaded display cases would remain de-energized for an interval between the times $T_{19}$ and $T_{21}$, and hence the refrigerator 6 could be turned off for the interval between the times $T_{19}$ and $T_{21}$ as far as the relatively highly loaded display units were concerned. However, due to the differently loaded display cases and phase differences between temperature changes, the refrigerator 6 remains de-energized only for the time interval $T_B$ between the times $T_{19}$ and $T_{20}$ which is shorter since the temperature in the display unit 1*a*' reaches the ON level at the tine $T_{20}$. As the display cases undergo more widely different loads and the temperature phase differences become greater, the time $T_{20}$ approaches the time $T_{19}$, reducing the time interval in which the refrigerator 6 can be turned off and hence the savings in electric power consumed by the refrigerator 6.

The cold storage and refrigeration system according to the fourth embodiment has been designed to overcome the above shortcoming.

Figure 10:
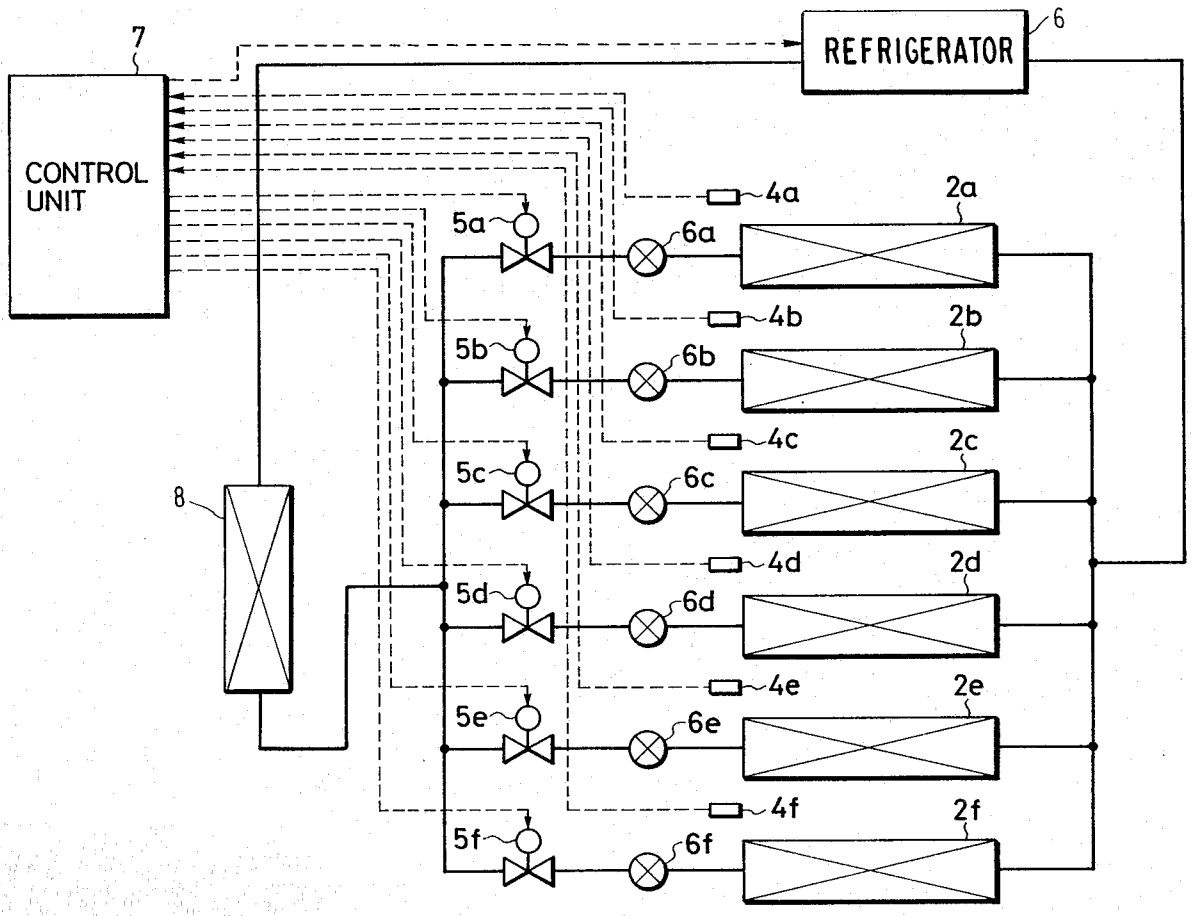
FIG. 10 is a schematic diagram of a cold storage and refrigeration system according to a fourth embodiment, the diagram being illustrative of a refrigerant circulation circuit and a control network.

The system according to the fourth embodiment is shown in FIG. 10, and has a control unit 7 which is different from the control unit according to the first embodiment. More specifically, the control unit 7 is shown in FIG. 12 and is of substantially the same construction as that of the control units 7 according to the first through third embodiments. However, the control unit 7 of the fourth embodiment differs therefrom in that the memory 7J stores a different control program, and the temperature setting unit 7G can establish settings for the ON, OFF, ON' and OFF' levels and another setting for a temperature level between the ON and OFF levels.

Figure 13:
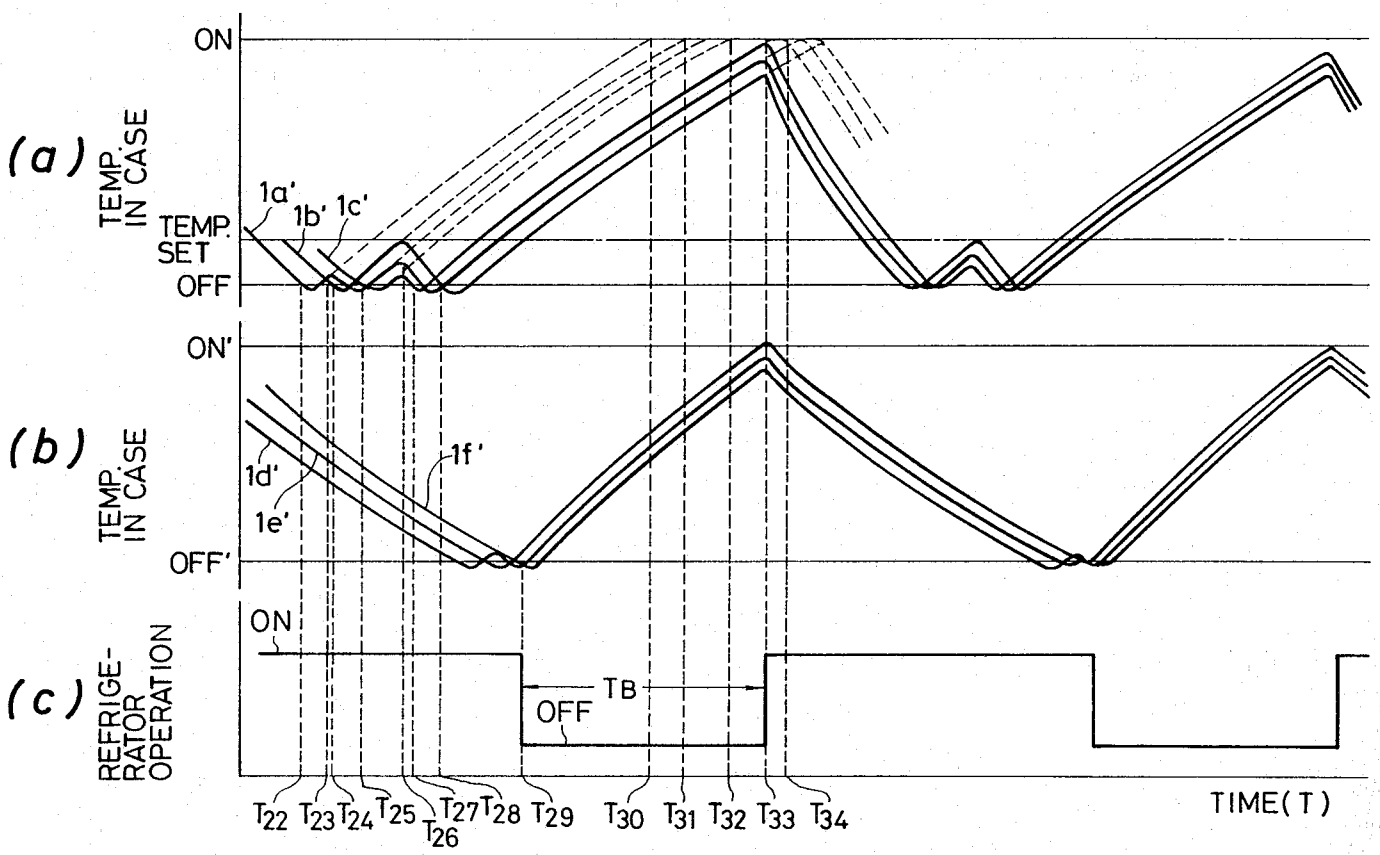
FIG. 13 is a timing chart showing the operations of the cold storage and refrigeration system in accordance with the fourth embodiment.

FIG. 13 illustrates controlling patterns for the display case temperatures and refrigerator operation when the cold storage and refrigerator system is controlled by the control unit according to the fourth embodiment. In FIG. 13, designated at (a) and (b) are variations in the temperatures in the display cases as detected by temperature sensors, and in (c), the pattern of energization and de-energization of the refrigerator 6.

The temperatures in the display units 1*a*' through 1*f*' vary as shown by the solid lines at (a) and (b) in FIG. 13. More specifically, the temperature in the display case 1*a*' reaches the OFF level at a time $T_{22}$. The temperature in the display case 1*a*' reaches the OFF level again at a time $T_{23}$ after it has dropped below the OFF level. The temperature in the display case 1*b*' reaches the OFF level at a time $T_{24}$. The temperature in the display case 1*c*' reaches the OFF level at a time $T_{25}$ later than the other lightly loaded display cases 1*a*', 1*b*'. At a time $T_{24}$, the temperature in the display case 1*b*' arrives at a temperature level set between the ON and OFF levels. After the temperature in any one of the display cases 1*a*' through 1*c*' has reached the set temperature level, they are cooled again, and the temperature in one of them reaches the OFF level at a time $T_{27}$ at the latest, and the temperature in another reaches the OFF level at a time $T_{28}$ at the latest. At a time $T_{29}$, the OFF' level is traversed at the latest by the temperature in one of the display cases 1*f*' which are relatively highly loaded. Designated at $T_{30}$ is a time at which the temperature in the display case 1*a*' would reach the ON level if that temperature reached the OFF level at the time $T_{22}$ to close the solenoid-operated valve 5*a* and then increased. Likewise, designated at $T_{31}$, $T_{32}$ are times at which the temperatures in the display cases 1*b*', 1*c*' would reach the ON level if those temperatures reached the OFF level at the times $T_{24}$, $T_{25}$ and were then allowed to increase. After all of the solenoid-operated valves 5*a* through 5*f* have been closed simultaneously, the temperature in one of the display cases reaches the ON or ON' level at the fastest at the time $T_{33}$. In the illustrated embodiment, the temperature in the display case 1*e*' reaches the ON' level at such time $T_{33}$. The temperature in the display case 1*c* would arrive at the ON level at a time $T_{34}$ if that temperature continued to rise after reaching the OFF level at the time $T_{27}$.

Control operation effected by the control unit according to the fourth embodiment will now be described with reference to FIG. 13. No description of the control unit 7 shown in FIG. 12 will be given as its construction can be understood from the description given with reference to the first through third embodiments.

The temperature in the display case 1*a*' reaches the OFF level at the time $T_{22}$ to close the solenoid-operated valve 5*a*, drops below the OFF level, and then rises above the OFF level at the time $T_{23}$, whereupon the solenoid-operated valve 5*a* is opened again to cool the display case 1*a*'. Thus, the temperature in the display case 1*a*' slightly rises and then is lowered. The interval of time during which the temperatures in the display cases 1*a*', 1*b*' 1*c*' reach the OFF level, that is, the temperature phase difference, is changed from the interval $T_{22}$–$T_{25}$ to the interval $T_{24}$–$T_{25}$. If the temperatures in the display cases 1*a*', 1*b*', 1*c*' increased from the times $T_{22}$ through $T_{24}$, then the time at which the temperature in one of the display cases 1*a*', 1*b*', 1*c*' would reach the ON level at the fastest would be shifted from the time $T_{30}$ to the time $T_{31}$. Therefore, by cooling the display case 1*a*' again, the temperature phase difference may be delayed in time, so that the time interval during which all of the solenoid-operated valves 5*a* through 5*f* remain closed can be increased from the interval $T_{29}$–$T_{30}$ to the interval $T_{29}$–$T_{31}$. Then, the temperature in the display case 1*b*' reaches the temperature level set between the OFF and ON level at the time $T_{26}$, at which time the solenoid-operated valves 5*d*, 5*e*, 5*f* for the display cases 1*d*', 1*e*', 1*f*' remain open, and the solenoid-operated valves 5*a*, 5*b*, 5*c* for the display cases including the case 1*b*' and having the temperatures above the OFF level are all opened. The temperatures in the display cases 1*a*', 1*b*', 1*c*' are then lowered. Thereafter, the temperature in the display case 1*c*' reaches the OFF level at the time T27 at the fastest, and the temperatures in the display cases 1*a*', 1*b*' reach the OFF level successively. The temperature in the display cases 1*c*', 1*a*', 1*b*' rise again in the order of arrival at the OFF level, and the temperature in the display case 1*c*' reaches the OFF level faster than the temperature in the other display cases. Thus, the time at which the temperature in one of the display cases reaches the ON level at the fastest is shifted from $T_{31}$ to $T_{34}$ by opening the solenoid-operated valve for the display case having its temperature arriving at the set temperature level at the time $T_{26}$ to thereby cool the display cases again. The solenoid-operated valves 5*d*, 5*e*, 5*f* for the display cases 1*d*', 1*e*', 1*f*', respectively, are all closed at the time $T_{29}$, and the temperature in the display case 1*e*' reaches the ON' level at the time $T_{33}$ faster than the other display cases 1*d*', 1*f*'.

The solenoid-operated valves for the relatively highly loaded display cases remain closed for the interval of time between the times $T_{29}$ and $T_{33}$. Simultaneous de-energization of the solenoid-operated valves 5*a*, 5*b*, 5*c* for the relatively light loaded display cases continues during the interval $T_{28}$–$T_{31}$ when the display cases are not again cooled at the set temperature level, and during the delayed interval $T_{28}$–$T_{34}$ when the display cases are cooled again at that temperature level. Since the refrigerator 6 is kept de-energized while all of the solenoid-operated valves 5*a*–5*f* remain closed, the refrigerator 6 is turned off during the interval $T_{29}$–$T_{31}$ when the display cases are not cooled at the time $T_{26}$ at the set temperature level, and can be turned off for the longer period of time $T_{29}$–$T_{33}$ by cooling the display cases again in order to delay the interval during which the lightly loaded display cases 5*a*, 5*b*, 5*c* are allowed to rise to the level. Therefore, electric power consumed by the refrigerator 6 can be held to a minimum.

Where the temperature changes in each group of display cases are substantially in phase, the time interval $T_{29}$–$T_{33}$ in which the solenoid-operated valves 5*d*, 5*e*, 5*f* for the relatively heavily loaded display cases are closed is shorter than the time interval $T_{28}$–$T_{34}$ in which the solenoid-operated valves 5*a*, 5*b*, 5*c* for the relatively lightly loaded display cases are closed. Accordingly, the time interval of de-energization of the refrigerator 6 can be determined by the time interval in which the solenoid-operated valves 5*d*, 5*e*, 5*f* for the relatively highly loaded display cases are closed, and has a maximum value $T_b$.

With the above arrangement, the display cases can reach the ON level at a delayed time by first cooling one of display cases again at the time $T_{23}$ to place the temperature changes in phase and then cooling the display cases again at the time $T_{26}$ at the set temperature level. Thus, the time interval $T_B$ during which the refrigerator 6 remains turned off can be maximized, with resulting increased savings in electric power consumption by the refrigerator 6.

After the display cases 1*a*', 1*b*', 1*c*' have been cooled again at the time $T_{26}$, if the temperature in one of the lightly loaded display cases, say 1*c*', reaches the ON level faster than the temperature in one of the heavily loaded display cases, say 1*e*', reached the ON' level, that is, if the time $T_{34}$ at which the temperature in the display case 1*c*' hit the ON level preceded the time $T_{33}$, then all of the solenoid-operated valves 5*a*–5*f* would be opened prior to the time $T_{33}$ to start operating the refrigerator 6. This would result in a failure of the time at which the solenoid-operated valves 5*d*, 5*e*, 5*f* for the heavily loaded display cases are closed to serve effectively as the time of de-energization of the refrigerator 6. Such a difficulty can be eliminated by raising the set temperature level by a predetermined interval so as to delay the time $T_{26}$ for recooling, with the result that the time $T_{34}$ at which the temperature in one of the lightly loaded display cases reaches the ON level at the fastest can be delayed. By repeating this time delaying control for successive cycles of operation, the time $T_{34}$ can follow the time $T_{33}$ at all times, and the maximum time interval $T_B$ is available for refrigerator de-energization.

When all of the solenoid-operated valves 5*a*–5*f* remain closed at the time at which one of the display cases, for example the display case 1*b*', reaches the set temperature level as shown in FIG. 13, the display cases will not be cooled again at the set temperature level, but continue to increase their temperatures. If the temperature in the display case 1*b*' reached the ON level prior to the arrival of the temperature in one of the display cases in the other group, for example the display case 1*e*', at the ON' level, then the time at which th solenoid-operated valves 5*d*, 5*e*, 5*f* for the relatively heavily loaded display cases fails to serve effectively as the time at which the refrigerator 6 is to be turned off. To avoid such a situation, the set temperature level is lowered by a predetermined temperature interval. By repeating such control, the display cases will be cooled again at the newly set temperature level to delay the time at which the temperature in the display case 1*b*' hits the ON level. Thus, the refrigerator 6 remains de-energized for an optimum period of time.

Figure 14:
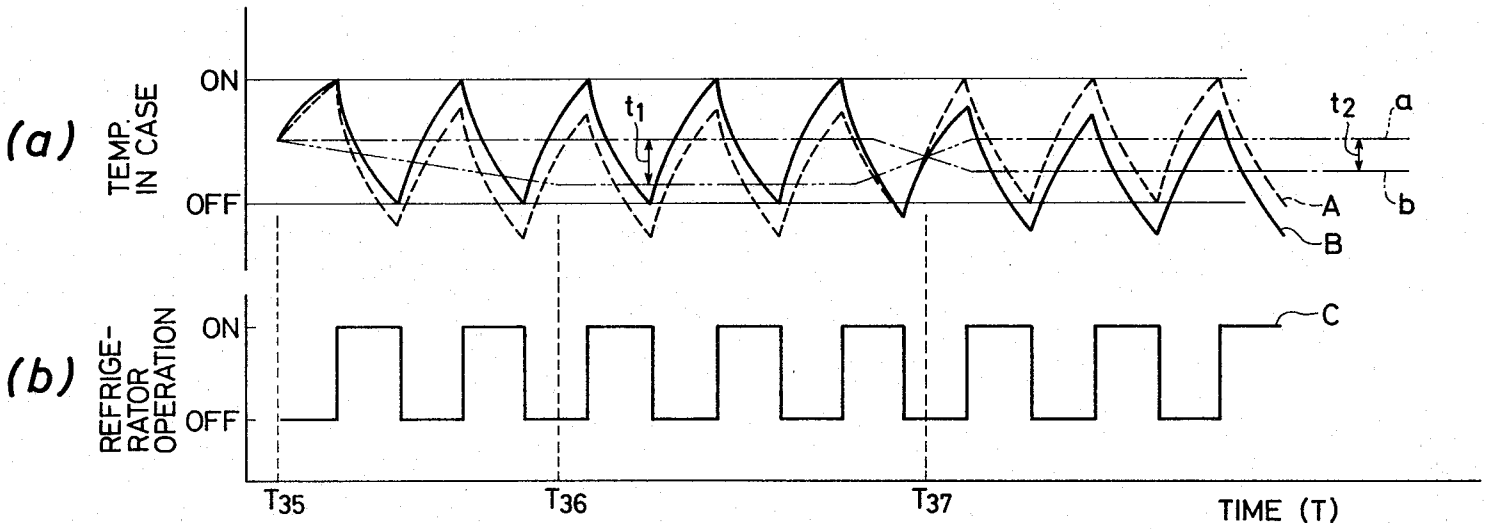
FIG. 14 is a timing chart illustrative of the operation of a cold storage and refrigeration system according to a fifth embodiment of the present invention.

A cold storage and refrigeration system according to a fifth embodiment will now be described with reference to FIGS. 1 and 14. The system of the fifth embodiment is of substantially the same construction shown in FIG. 1, but differs therefrom in that it has a different control unit 7. When the solenoid-operated valves 5*a*, 5*b* for the display cases 1*a*, 1*b* are opened and closed synchronously, the temperatures in the display cases 1*a*, 1*b* are substantially equal at a time $T_{35}$, but become progressively different from each other with time as the display cases 1*a*, 1*b* contain varying cooling loads. With the higher temperature B in the display case 1*b* being controlled, the difference between the average temperatures a, b in the display cases 1*a*, 1*b* is $t_1$ at a time $T_{36}$ and becomes stable.

Since the cooling loads in the display cases 1*a*, 1*b* vary with the goods stored therein and with surrounding conditions, the cooling loads may be switched around in proportion at a time T37 resulting in the temperature A in the display case 1*a* being higher than the temperature B in the display case 1*b*. At this time, the temperature B is controlled for keeping the average temperature b in the display case 1*b* lower than the average temperature a in the display case 1*a* by a constant interval $t_2$ to maintain the stored goods fresh for a long period of time. At this time, the refrigerator 6 operates in a pattern identical to the pattern in which the solenoid-operated valves 5*a*, 5*b* are opened and closed for temperature control, and thus will be de-energized at desired periods of time.

While in the above embodiment the temperature in that one of the display cases 1*a*, 1*b* which is higher than that in the other is selected to be controlled, the control unit 7 may be constructed such that the temperature in one of the display cases 1*a*, 1*b* will be controlled at all times, or the average of the temperatures in the display cases 1*a*, 1*b* will be controlled to maintain a longer period of time in which the refrigerator 6 is turned off. Furthermore, the system according to the fifth embodiments will remain just as effective when the temperatures to be controlled are picked up either within the display cases 1*a*, 1*b*, the air outlets, or air inlets.

With the system of the fifth embodiment being thus constructed, the temperature sensors 4*a*, 4*b* produce outputs for simultaneously controlling the solenoid-operated valves 5*a*, 5*b* for closing or opening, and the refrigerator 6 for the energization or de-energization. The patterns of operation of the display cases 1*a*, 1*b* may be synchronized while monitoring the temperatures in the display cases 1*a*, 1*b*, so that the refrigerator 6 can remain turned off for a maximum period of time. Therefore, power consumption by the refrigerator 6 can be greatly reduced.

Although certain preferred embodiments have been shown and described, it should be understood that many changes and modifications may be made therein without departing from the scope of the appended claims.

What is claimed is:

1. A cold storage and refrigeration system comprising:

a refrigerator;

a plurality of cold storage and refrigeration units divided into two groups, one relatively heavily loaded and the other relatively lightly loaded, and having evaporators, respectively, connected to said refrigerator for passage therethrough of a refrigerant when said refrigerator is in operation;

a plurality of temperature sensors installed respectively in said cold storage and refrigeration units for detecting first and second levels of temperature respectively therein;

a plurality of valves connected respectively to said evaporators and closable for stopping the flow of said refrigerant in response to a detection of said second temperature level by said temperature sensors and openable for allowing said refrigerant to flow through said evaporators in response to a detection of said first temperature level by said temperature sensors; and a control unit responsive to signals supplied from said temperature sensors for controlling said refrigerator and said valves such that one of said valves which belongs to one of said groups and which is earliest closed is again opened if any of the other valves associated with said one of said groups is open when the cold storage and refrigeration unit coupled with said one of said valves has a temperature increased from below said second temperature level to higher than the latter; that any of said valves associated with said one of said groups and coupled with those cold storage and refrigeration units which have temperatures higher than said second temperature level is opened when any of said cold storage and refrigeration units in said one of said groups has a temperature which has become higher than a predetermined temperature level between said first and second temperature levels after having reached said second temperature level and when at least one of said valves remains open; and that said refrigerator is deenergized when all of said valves are closed; and all of said valves are opened and said refrigerator is energized when at least one of said valves is opened at said first temperature level.

2. A cold storage and refrigeration system according to claim 1, said control unit being further arranged such that said predetermined temperature level is increased by a certain interval if the temperature in one of said cold storage and refrigeration units in one of said groups reaches said first temperature level at the earliest after the valves associated with said one group have been opened and includes a cold storage and refrigeration unit having a temperature becoming higher than said predetermined temperature level at the earliest after having reached said second temperature level.

3. A cold storage and refrigeration system according to claim 1, said control unit being further arranged such that said predetermined temperature level is reduced by a certain interval if all of said valves are closed and the temperature in one of the cold storage and refrigeration units in one group reaches said first temperature level at the earliest when one of the cold storage and refrigeration units in said group reaches said predetermined temperature level after having reached said second temperature level.

4. A cold storage and refrigeration system comprising:

a refrigerator;

a plurality of cold storage and refrigeration units having evaporators, respectively, connected to said refrigerator for passage therethrough of a refrigerant when said refrigerator is in operation;

a plurality of temperature sensors installed respectively in said cold storage and refrigeration units for detecting first and second levels of temperature respectively therein:

a plurality of valves connected respectively to said evaporators for controlling the flow of said refrigerant through said evaporators; and a control unit responsive to signals supplied from said temperature sensors for controlling said refrigerator and said valves in order to energize said refrigerator and said valves in response to a detection of said first temperature level by any one of said temperature sensors when said refrigerator is de-energized, whereby said refrigerant can flow through said evaporators simultaneously, said control unit being further responsive to the detection of said second temperature level by temperature sensors while said refrigerator is in operation for respectively closing said valves associated with said temperature sensors, and responsive to the closing of all of said valves to de-energize said refrigerator.

* * * * *